United States Patent [19]

Garrett et al.

[11] Patent Number: 4,946,408

[45] Date of Patent: Aug. 7, 1990

[54] MALE CIRCUIT BOARD TERMINAL

[75] Inventors: Roger L. Garrett, New Wilmington, Pa; Behrooz S. Niknafs, Kokomo, Ind.

[73] Assignee: General Motors Corporation, Detroit, Mich.

[21] Appl. No.: 407,090

[22] Filed: Sep. 14, 1989

[51] Int. Cl.[5] ..... H01R 9/09

[52] U.S. Cl. ..... 439/872; 439/866; 439/876

[58] Field of Search ..... 439/55, 82, 83, 746, 439/747, 748, 749, 871, 872, 876, 866

[56] References Cited

U.S. PATENT DOCUMENTS

| | | | |
|---|---|---|---|
| 3,072,880 | 1/1963 | Olsson | 439/872 |
| 3,562,698 | 2/1971 | Merry | 439/872 |
| 3,742,430 | 6/1973 | Cairns et al | 439/872 |
| 3,808,588 | 4/1974 | McGregor | 439/872 |
| 3,960,425 | 1/1976 | Kirk, Jr. et al | 439/55 |
| 3,995,931 | 12/1976 | Pienkowski | 439/872 |
| 4,139,727 | 2/1979 | Kuballa | 439/55 |

PUBLICATIONS

Exhibit A, Packard Electric Print 1204 8424.
Exhibit B, Molex Catalogue p. 25L.

*Primary Examiner*—Neil Abrams
*Attorney, Agent, or Firm*—F. J. Fodale

[57] ABSTRACT

A male circuit board terminal includes a unitary electrically conductive housing with an outboard section, a core section and an inboard section arranged to provide a sound mechnical connection and electrical connection between the circuit board and a cut electrical lead. The outboard section includes first and second pairs of crimping tabs to respectively connect the terminal to the cut electrical lead and to connect the wire strands from the cut lead outboard of the board through a distance which prevents dewetting of a solder connection between the terminal and the circuit board; the terminal also includes a third pair of crimping tabs on the core section to contain wire strands in the plane of the circuit board at a connection hole therethrough and to provide a positive electrical connection between the strands and conductive plating at the connection hole and a low pressure crimp is provided on the inboard end of the terminal which protects the lock tang and terminal during insertion thereof into the board and wherein the locking tang and terminal are configured to ensure retention of the terminal on the board while defining a solder pocket which completely wets the ends of the wire strands and the section of the wire strands within the plane of the board for providing electrical continuity therebetween.

6 Claims, 1 Drawing Sheet

MALE CIRCUIT BOARD TERMINAL

FIELD OF THE INVENTION

This invention relates to terminals for connection of cut leads to a printed circuit board and more particularly to crimped terminals for securing a cut lead to a circuit board by use of a solder joint.

BACKGROUND ART

Various forms of crimp terminals are known for connecting a cut lead to a circuit board. In one such terminal the cut lead is connected by a first pair of crimping tabs dimensioned to locate the insulation cover of the cut lead closely adjacent the plane of the circuit board. One problem with such terminals is that wire strands which are crimped to the terminal within the plane of the board may not be properly wetted during a solder connection process.

Another form of crimped terminal for connecting wire strands to a printed circuit board is shown in U.S. Pat. No. 3,072,880 issued Jan. 8, 1963 to B. E. Olsson. The terminal of the U.S. Pat. No. 3,072,880 includes stop flanges for limiting the distance the terminal can be inserted into a circuit board. The terminal includes only one pair of crimping tabs which grip wire strands only at the outboard surface of the circuit board. The wire strands and connecting crimping tabs are located closely adjacent the cover insulation of a cut wire lead. Such disposition can cause a dewetting problem if the terminal requires a solder joint for ensuring both mechanical and electrical connection reliability.

U.S. Pat. No. 3,562,698 issued Feb. 9, 1971 to R. W. Merry discloses an electrical contact in which a unitary electrically conductive terminal housing is crimped on wire strands extending from the end of a cut lead wire. The terminal is configured to form a hollow lead prong or lance which can be inserted into a female connector. There is no suggestion that the terminal be modified to provide a structure which will capture the inboard and outboard surfaces of a printed circuit board to hold wire strands from a cut lead wire with respect to the circuit board so that the wire strands can be soldered to the circuit board at both the inboard and outboard surfaces thereof.

U.S. Pat. No. 3,742,430 issued June 26, 1973 to Cairns et al discloses an electrical terminal for connecting a lead to a printed circuit board at an edge board connection. It is not configured to provide for full wetting solder connection of a terminal at both the inboard and outboard surfaces of a printed circuit board.

STATEMENT OF INVENTION AND ADVANTAGES

In accordance with the present invention, a male circuit board terminal is provided which will connect wire strands of a cut lead wire in the plane of a circuit board at a connection hole therethrough so as to provide full wetting of the wire strands at both the inboard and outboard surfaces of the circuit board.

A feature of the present invention is to provide such connection by use of a unitary electrically conductive terminal housing with outboard, core and inboard sections configured to provide an outboard clamping of wire strands which will prevent the electrical insulation of a cut lead wire from dewetting the wire strands during formation of a solder joint at the inboard and outboard surfaces of the circuit board.

Yet another feature of the present invention is to prevent solder dewetting at a connection between such a terminal and such wire strands by providing first and second pairs of crimping tabs on the outboard section of the terminal and wherein one of the pairs of crimping tabs captures the wire strands extending from the cut wire lead through a distance which will prevent electrical insulation on the cut wire lead from dewetting the wire strands at solder joints formed at the inboard and outboard surfaces of the circuit board.

Still another feature of the present invention is to provide the terminal of the present invention with a third pair of crimping tabs on the core section of the terminal and to provide stops and a forward bend lock tab on the terminal which will position the third pair of crimping tabs and the wire strands of the cut wire lead in the plane of the circuit board at a location so as to prevent dewetting of the wire strands held by the third pair of crimping tabs when the terminal is soldered into a connection hole of the circuit board.

Yet another object of the present invention is to form the forward locking tab of the preceding feature in association with a fourth pair of low pressure crimping tabs to form a pocket which contains the ends of the wire strands and which will receive solder to coat the ends of the wire strands with a solder joint having a fillet which is located closely adjacent the inboard surface of the circuit board to provide a high strength mechanical connection between the inboard surface of the circuit board and the inboard section of the terminal.

Still another object of the present invention is to provide the fourth pair of low pressure crimping tabs with a outer surface which defines a piloting nose which protects the wire strands and terminal as it is directed through the connection hole of a printed circuit board prior to solder connecting the terminal in place on the circuit board.

Other advantages of the present invention will be readily appreciated as the same becomes better understood by reference to the following detailed description when considered in connection with the accompanying drawings wherein:

DETAILED DESCRIPTION OF THE PREFERRED EMBODIMENT

Figure 1:
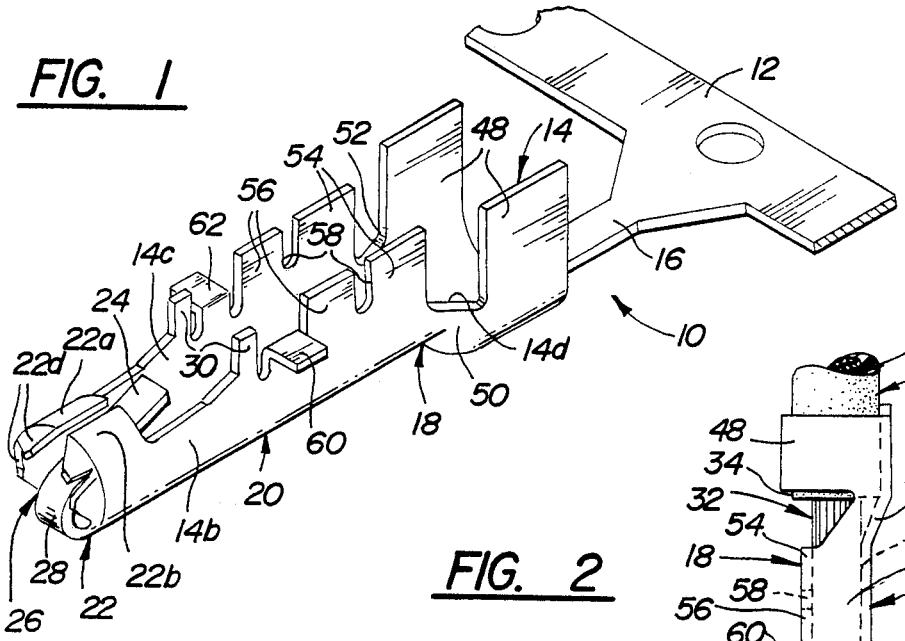
FIG. 1 is an enlarged perspective view of a terminal in accordance with the present invention as formed on a manufacturing strip.

FIG. 1 illustrates a male circuit board terminal 10 of the present invention in the shape that it is formed on a manufacturing strip 12. The terminal 10 includes a unitary electrically conductive housing 14 which can be shaped as shown by known high speed production stamping and forming equipment and formed as a series of separate terminal parts on the side of the production strip 12 where each of the terminals 10 are connected by a side leg 16 formed integrally of the housing 14 and the strip 12.

More particularly, in the manufactured form the terminal 10 includes an outboard section 18, a core section 20 and an inboard section 22. The sections 18, 20 and 22 are joined by a surface 14*a* for supporting wire strands on the conductive housing 14. They are also formed in part by a pair of housing walls 14*b* and 14*c* that combine with the surface 14*a* to form a cavity 14*d* along the length of the housing 14 into which the wire strands of a cut wire lead can be placed prior to crimping the terminal 10 to a cut wire lead.

More specifically, the inboard section 22 includes a pair of low pressure crimping tabs 22*a*, 22*b* which are bent as shown in FIG. 1 to form a surface 22*c* thereon that will engage the free end 24 of a forward lock tab 26 formed as an extension of the support surface 14*a* and including a reverse bend portion 28 thereon that will protect and cover the ends of wire strands placed in the cavity 14*d* as will be described.

The crimping tabs 22*a*, 22*b* have curved outer nose surfaces 22*d* thereon that define a pilot for directing the terminal 10 into a retained position with a connecting hole of a circuit board.

Figure 2:
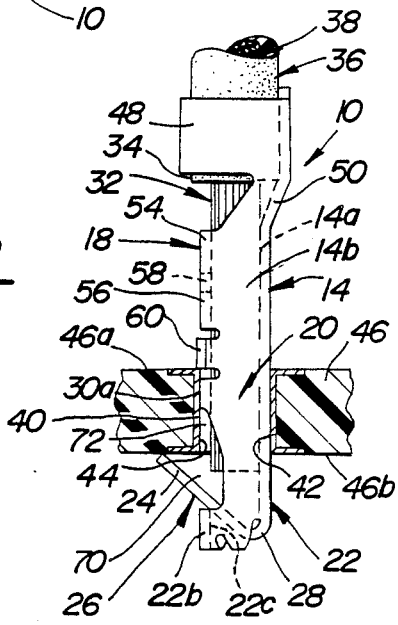
FIG. 2 is an enlarged side elevational view of the terminal of the present invention shown crimped on the wire strands of a cut lead wire and inserted through a connection hole of a printed circuit board shown in cross-section.
Figure 3:
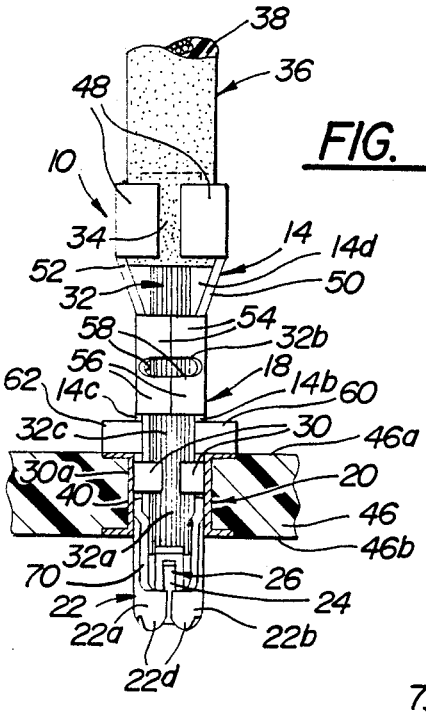
FIG. 3 is an enlarged front elevational view of the terminal connection shown in FIG. 2.

The core section 20 includes a pair of crimping tabs 30 which extend in the plane of the housing walls 14*a*, 14*b* and which can be crimped to capture a bundle 32*a* of the wire strands 32 which extend from the cut end 34 of a lead wire 36 having an electrical insulating cover 38, as shown in FIGS. 2 and 3. When crimped, the crimping tabs 30 prevent frayed cable strands and ensure complete solder coverage of the cable strands. The crimping tabs 30 also define a side surface 30*a* which will engage electrically conductive plating 40 which is formed on the walls 42 of a connecting hole 44 formed through a printed circuit board 46 formed from suitable electrical insulating material.

The outboard section 18 includes a first pair of crimping tabs 48 which when bent will capture the cut end 34 at the insulating cover 38. The crimping tabs are connected by transition sections 50, 52 to a second pair of crimping tabs 54, 56 each having a length that is interrupted by an open ended side relief groove 58 which will ensure that the tabs 54, 56 will be easily formed into a clamped relationship with a bundle 32*b* of the wire strands 32. One feature of the invention is that the crimping tabs 54, 56 form a structural spacer bridge between the cut end 34 and the point of connection of the terminal 10 within the circuit board 46 which will locate the cut end 34 a substantial distance from solder connections to be described. The distance is selected such that the wire strand bundle 32*a* and a wire strand bundle 32*c* at the outboard surface of circuit board 46 will not be dewetted by vapor from the material comprising the electrical insulating cover 38.

A further feature of the present invention is the provision of a pair of stop tabs 60, 62 formed respectively on the side walls 14*b*, 14*c* at a point immediately inboard of the crimping tabs 54, 56. As shown in FIG. 3, when the terminal 10 has been crimped on the wire strands 32 and inserted into the connection hole 44, the surface 30*a* will tightly fit against the plating 40 and the crimped wire strands 32 within the plane of the circuit board 46 and provide a first mechanical interface between the terminal 10 and the circuit board 46. The stop tabs 60, 62 engage the outboard surface 46*a* of the circuit board 46 to limit the entry of the terminal 10 therethrough. The free end 24 of the forward lock tab 26 will spring a limited side distance when it clears the inboard surface 46*b* of the board to cause the board 46 to be held between the stop tabs 60, 62 and the free end 24 so as to ensure that the terminal 10 will be securely held in place before it is soldered in place in the connection hole 44.

During insertion of the terminal 10, the surfaces 22*d* pilot the inboard section 22 through the connection hole 44 and along with the reverse bend portion 28 and the crimping tabs 30 serve to protect the ends of the wire strands so that they will remain within the confines of the cavity 14*c*.

Figure 4:
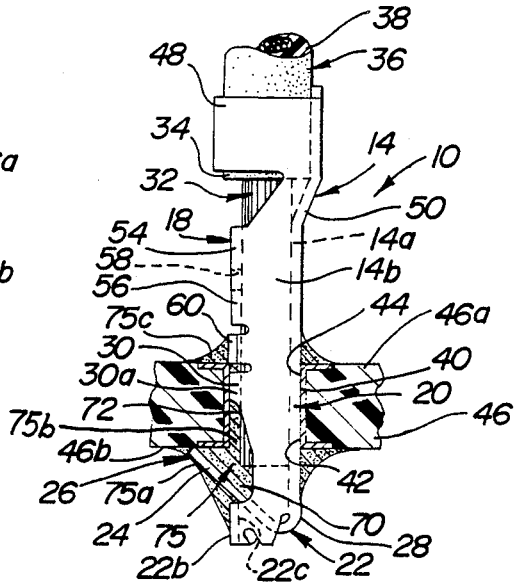
FIG. 4 is an enlarged side elevation view of the terminal connection shown in FIG. 2 following formation of solder joints on the inboard and outboard surfaces of the circuit board.

Once the terminal 10 is fully inserted and fixed to the circuit board 46 by the tabs 60, 62, 26 the circuit board 46 is placed in a solder bath which will fill a solder pocket 70 within the inboard section 22. The solder will flow through the connection hole 44 to fill the space 72 between the inner surfaces of the core section 18 and the interstices formed between the wire strands in the core section 20 onto the inboard surface 46*b*. The resultant solder joint 75 has an inboard fillet section 75*a*, a core 75*b* and an outboard fillet section 75*c* all shown in FIG. 4. The length of the inboard section 22 of the terminal 10 is selected so that the fillet section 75*a* defines a compact form closely adjacent the inboard surface 46*b* to provide a strong mechanical connection between the inboard section 22 and the circuit board 46.

While our invention has been described in terms of a preferred embodiment, it will be appreciated it has other uses as for example in association with cut lead lines requiring connection to sensor boards used in automotive control systems that are connected to lead wires of a wiring harness. Other additional forms are readily apparent to those skilled in the art. Accordingly, the scope of our invention is to be considered limited only by the following claims.

What is claimed is:

1. A male circuit board terminal for mechanically and electrically connecting a wire end having an insulating cover and wire strands extending therefrom to electrically conductive plating on a circuit board at a terminal connection hole extending between inboard and outboard surfaces of the board comprising:

a unitary electrically conductive housing having inboard, outboard and core portions thereon, said inboard, outboard and core portions each having a strand support surface along the length thereof and spaced side wall portions;

said side wall portions including a first pair of crimping tabs thereon for connecting said outboard portion to the outer surface of the wire end;

a second pair of crimping tabs on said side wall portions at said outboard portion, said second pair of crimping tabs engageable with the strands where said strands extend from the wire end;

a pair of stops formed in said side wall portions immediately inboard of said second pair of crimping tabs and extending outwardly of said side wall portions into overlying engagement with one surface of the circuit board to position the terminal in a seated relationship on the circuit board;

and lock finger means integrally formed on the inboard end of said terminal, said lock finger means including a return bend portion wrapping around the ends of said strands to form a solder pocket therearound and including a free end portion thereon engageable with the other surface of the circuit board to resiliently capture the circuit board between said pair of stops and said lock finger means.

2. In the terminal of claim 1, a third pair of crimping tabs formed by said side wall portions engageable with the wire strands at said core portion and having a side surface portion thereon engageable with conductor strip means in the connection hole of said circuit board for electrically connecting the strands to the conductor strip in the connection hole.

3. In the terminal of claim 1, nose means including said lock finger means to form a closed pocket at the inboard portion to form a solder pocket containing the ends of said wire strands immediately inboard of the inboard surface of the circuit board.

4. The terminal of claim 3, further characterized by said nose means including a fourth pair of crimping tabs bendable into overlying relationship with said lock finger means to hold said lock finger means inwardly of said terminal.

5. The terminal of claim 1, further characterized by said second pair of crimping tabs having a length which will space the wire end from the connection hole a distance to prevent the insulating cover from dewetting the area of solder connection between the terminal and the board during soldering of the terminal to the board.

6. The terminal of claim 3, further characterized by said nose means including a low pressure crimp thereon which contains the ends of said strands and which forms a solder pocket that provides a full solder joint from the inboardmost end of said inboard portion to the inboard end of the circuit board, the solder joint having a fillet whose radius is greater than the depth of penetration of the terminal inboard of the circuit board.

* * * * *